United States Patent [19]

Schall

[11] 3,991,827

[45] Nov. 16, 1976

[54] WELL CONSOLIDATION METHOD

[75] Inventor: Michael D. Schall, Lafayette, La.

[73] Assignee: Atlantic Richfield Company, Los Angeles, Calif.

[22] Filed: Dec. 22, 1975

[21] Appl. No.: 642,892

[52] U.S. Cl. ..... 166/253; 166/294; 166/295

[51] Int. Cl.[2] ..... E21B 33/138; E21B 47/10

[58] Field of Search ..... 166/253, 250, 276, 278, 166/285, 289, 292–295; 73/151, 152, 155

[56] References Cited

UNITED STATES PATENTS

| | | | |
|---|---|---|---|
| 2,183,654 | 12/1939 | Moore | 166/250 |
| 2,660,887 | 12/1953 | Frei | 166/253 X |
| 3,031,571 | 4/1962 | Fearon | 73/153 X |
| 3,173,293 | 3/1965 | Eckels | 166/253 X |
| 3,796,883 | 3/1974 | Smith et al. | 166/250 X |

*Primary Examiner*—Stephen J. Novosad
*Attorney, Agent, or Firm*—Roderick W. MacDonald

[57] ABSTRACT

In a method wherein two or more separate zones in a single wellbore are subjected to a consolidation treatment to prevent the production of solid particles from those zones into the wellbore, a tracer material is incorporated into each zone which is subjected to the consolidated treatment, the tracer material being unique to that particular zone. Thereafter, fluid produced from the well is analyzed to determine if any and, if so, which zone or zones are still leaking solid particles into the well. Subsequent consolidation retreatment of the well is then limited to the zone or zones indicated to be leaking solid particles rather than being applied to all zones in the well again.

3 Claims, 1 Drawing Figure

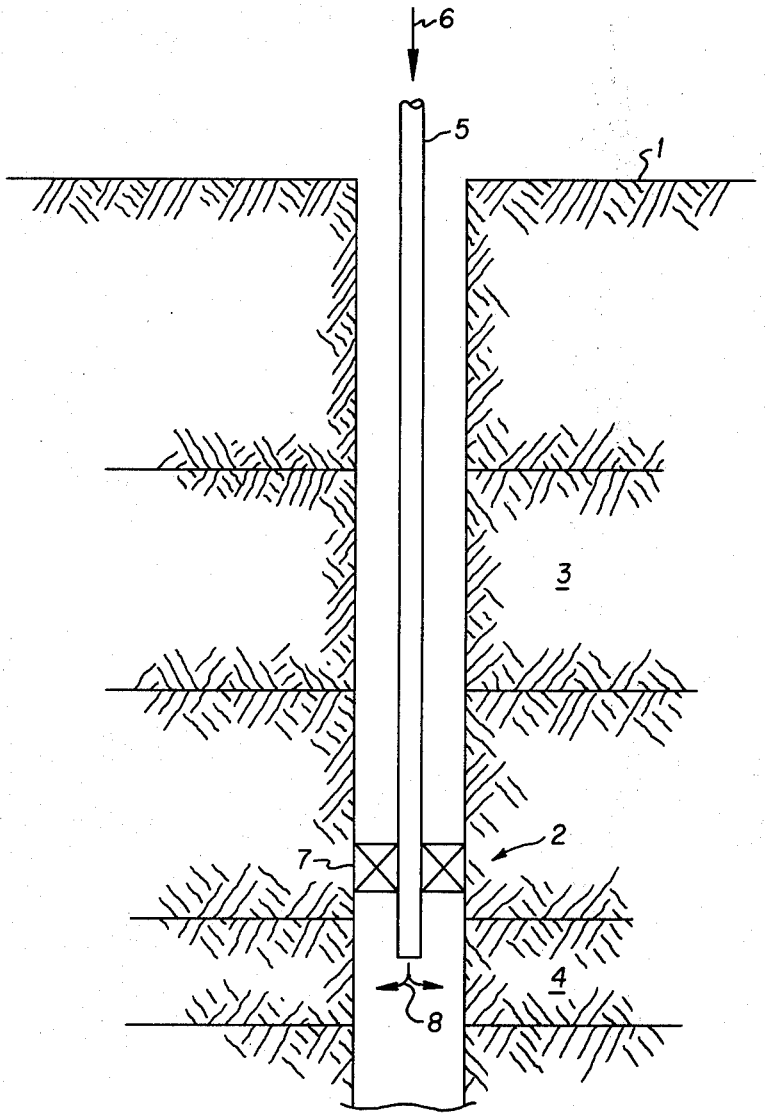
6
5
1
3
2
7
4
8

WELL CONSOLIDATION METHOD

Cross References to Related Applications

None.

Background of the Invention

In a number of areas of the world such as the Gulf coast of the United States, there are geologic formations or zones through which a wellbore penetrates when drilling a well such as an oil or gas well, which formations or zones contain solid particles that are not strongly held in place. These particles, e.g., sand, tend to flow into the wellbore as fluids such as oil and gas flow from the interior of the zones into the wellbore and are pumped to the surface of the earth.

Sand being pumped through the producing equipment of a well can in some situations cause increased wear and tear on that equipment. Therefore, it is desirable to prevent the production of solid particles into the wellbore.

Accordingly, various procedures have been devised for consolidating loosely-held solid particles in their formation so that subsequent production of fluids from that formation into the wellbore does not also carry solid particles into the wellbore. Such a procedure is herein referred to as a consolidation treatment.

Oftentimes a wellbore passes through two or more producing formations or zones and it can happen that two or more zones in a single well can each be producing solid particles along with the fluids that are desired to be recovered from the well. In such a situation a consolidation treatment is applied to each of the however many zones that are producing solids into the wellbore. Sometimes a single consolidation treatment will not be sufficient to reduce the production of solids into the wellbore to the desired extent and retreatment of one or more zones in a wellbore can be necessary. When two or more zones have been treated in a single wellbore and one or more of these zones is still leaking solid particles into the wellbore to an undesirable extent, it can readily be determined at the earth's surface that solids are still getting into the well fluid but it cannot be determined which zone or zones are producing the solids. It is highly desirable to be able to pinpoint the zone or zones which require retreatment because then the workover job can be confined to the problem zones instead of retreating all zones in the well. This substantially reduces the workover costs and rig time necessary to get the well to full production.

Summary of the Invention

According to this invention, when a consolidation procedure is carried out in a well having at least two zones which are to be subjected to the consolidation treatment, a tracer material is incorporated in each zone which is subjected to the consolidation treatment. Each tracer material used is unique in itself so that each zone carries a distinguishable tracer material. Thereafter, upon production of fluid from the well, the produced fluid can be analyzed to determine if any and if so which zone or zones are still leaking solid particles into the wellbore. This way it can be determined if a consolidation retreatment is necessary and if so precisely which zone or zones need to be retreated.

Accordingly, it is an object of this invention to provide a new and improved method for consolidating a plurality of zones in a well. It is another object to provide a new and improved method for minimizing workover requirements when carrying out a consolidation procedure. It is another object to provide a new and improved method for determining what zones in a well require workover after an initial consolidation treatment.

Other aspects, objects and advantages of this invention will be apparent to those skilled in the art from this disclosure and the appended claims.

Detailed Description of the Invention

The drawing shows the cross section of a wellbore penetrating two zones in the earth.

More specifically, the drawing shows the earth's surface 1 having a wellbore 2 extending therein, the wellbore passing through producing zones 3 and 4. Communication from the earth's surface to the interior of the wellbore and, therefore, with zones 3 and 4 is provided by tubing 5. The consolidation treatment fluid is pumped through tubing 5, as shown by arrow 6, from the earth's surface down to the vicinity of the zone to be treated.

In the drawing, a conventional packoff 7 is placed above zone 4 so that in the setup of the drawing zone 4 is the zone under treatment. Consolidation treatment fluid passes into tubing 5 at the earth's surface and leaves the lower end of tubing 5 to pass into zone 4 as shown by arrows 8. Similarly, as is well-known in the art, when it is time to treat zone 3, tubing 5 is raised so the lower end thereof is in the vicinity of zone 3. Zone 3 is isolated such as by way of a packoff above zone 3 and a bridge plug below zone 3 so that the consolidation fluid leaving tubing 5 passes primarily only into zone 3. This way each zone is treated separately and can have incorporated thereinto before, during and/or after the consolidation treatment a tracer material that is unique to that particular zone.

In accordance with this invention, if both zones 3 and 4 are producing solid particles into the interior of wellbore 2, it is desirable to subject both zones to a consolidation treatment. Thus, each of zones 3 and 4 has incorporated thereinto a tracer material which is unique to that particular zone and after the consolidation procedure is completed for the entire well and the well put back on production, fluid produced from both zones into the wellbore and pumped to the earth's surface can be analyzed to determine if tracer material from either or both zones is present. If tracer material is present this not only indicates that solid particles are still being produced into the wellbore and a workover job required but also the zone or zones that should be retreated for additional consolidation. If it happens that only one of zones 3 and 4 is continuing to produce solid particles into the wellbore it can be definitely determined at the earth's surface which zone needs retreatment since the tracer material which is unique to that particular zone will be present in the produced fluids at the earth's surface. For example, should zone 3 be adequately consolidated by the initial treatment but zone 4 inadequately consolidated, the tracer material unique to zone 4 will be identifiable at the earth's surface and the workover job will then be limited only to zone 4. Heretofore, the workover job would have been directed to both zones 3 and 4 and any other zones that were initially treated in the wellbore since it would have been impossible at the earth's surface to determine which zone was inadequately consolidated.

The tracer material can be anything that can be differentiated from the other materials, including other tracer materials, used in the same well consolidation procedure. The tracer material can be solid, liquid, gaseous or any combination thereof so long as it marks solid particles in the zone in which it is incorporated so that should solid particles be produced from that zone, it can be determined at the earth's surface that that zone is inadequately consolidated. It is preferable that the tracer materials used in a given well consolidation procedure be visually differentiable from one another so that a determination of which zone, if any, needs reconsolidation can be made on the well site. For example, tracer materials composed of solid particles which are differently colored can be incorporated in each zone.

It is not required, however, that the tracer materials be subject to differentiation by visual inspection. The tracer materials can also be differentiated by chemical analysis, spectographic analysis, X-ray analysis, radioactive analysis and so on, it only being required that the various tracer materials used in a particular well be differentiable from one another should they be produced back to the earth's surface. The tracer materials should not be of a character such that they would mask one another should two or more thereof be produced back to the earth's surface at the same time but rather must be distinguishable from one another when mixed because, as has been mentioned before, two or more zones can need retreatment in a given well.

It should be understood that the term "zone" can describe separate geologic formations or separate areas within a single formation, this invention being intended to cover two or more areas within a wellbore whether the areas are considered to be the same or different goelogic formation.

When the tracer material is composed of solid particles, the particles can be of any composition, size, particle size grading, and the like so long as the tracer material does not interfere with the desired results of the consolidation treatment, the ability of the well to produce desired fluids, and the like. For example, the particulate tracer material could be sand, plastic beads, glass beads, and the like of various colors and can be used in widely varying amounts depending on the particular requirements of the well and how much must be used to be able, by visual inspection at the earth's surface, to determine if those particles are being produced back to the earth's surface.

Any conventional consolidation technique can be employed in this invention, such techniques being well-known in the art, for example see U.S. Pat. Nos. 3,815,680 and 3,285,339, the disclosures of which are incorporated herein by reference. Generally, the consolidating agent can be selected from a group of materials comprising thermosetting resins, thermoplastic polymers, rubber, wax, simple syrups, combinations of two or more thereof, and the like. Particularly suitable materials include, without limitation, phenol formaldehyde resin, furan resin, cellulose resin, styrene-butadiene rubber, reclaimed rubber, modified resins, residual hydrocarbon oils, heavy hydrocarbon oils, and the like.

The amount of tracer material employed will vary widely but generally is that which is sufficient to allow detection at the earth's surface should a small amount thereof be produced back into the wellbore. Generally, when the tracer material is employed during the consolidation treatment, a major amount of the tracer material, if it is a solid, can be used to replace the solids normally employed in the consolidation treatment.

Example

A well having a cross section essentially the same as that shown in the drawing contains two spaced apart unconsolidated formations. Red particulate tracer material is employed during the consolidation treatment of zone 3 and blue particulate tracer material is employed during the consolidation of zone 4, the amount of tracer material employed in each zone comprising about 70% by weight of the solids normally employed in the consolidation treatment. The colored particles employed in both zones 3 and 4 are PYREX beads having a size range of 0.015 inches to 0.030 inches.

Thereafter, the well is put on production at the desired rate and the produced fluid periodically analyzed visually to determine if either or both of the colored particles are being produced back to the earth's surface.

The embodiments of the invention in which an exclusive property or privilege is claimed are defined as follows:

1. In a consolidation method in a well having at least two separate zones which are to be subjected to the consolidation treatment, the improvement comprising incorporating in each zone which is subjected to said consolidation treatment a tracer material which has a color that is unique to that particular zone so that said colored tracer material is visually identifiable at the earth's surface, said tracer material being such that it will at least in part be produced back to the earth's surface if the consolidation treatment is not adequate, and analyzing at the earth's surface fluid thereafter produced from said well to determine if any and if so which zone is still leaking solid particles into said well.

2. The method of claim 1 wherein the tracer material is solid particles, and different colored particles are incorporated in each zone which is subjected to a consolidation technique.

3. The method of claim 1 wherein said tracer material is incorporated into each zone during the consolidation treatment of that zone.

* * * * *